United States Patent [19]

Janssen

[11] 4,318,538

[45] Mar. 9, 1982

[54] COUNTERBALANCED SUPPORT

[75] Inventor: Jozef T. A. Janssen, Eindhoven, Netherlands

[73] Assignee: U.S. Philips Corporation, New York, N.Y.

[21] Appl. No.: 125,078

[22] Filed: Feb. 27, 1980

[30] Foreign Application Priority Data

Feb. 28, 1979 [NL] Netherlands ..... 7901575

[51] Int. Cl.[3] ..... A61G 13/00

[52] U.S. Cl. ..... 269/324

[58] Field of Search ..... 269/322–325; 5/62, 66–69, 60; 297/90, 322, 316

[56] References Cited

U.S. PATENT DOCUMENTS 3,089,692 5/1963 Blomquist ..... 269/323

4,139,917 2/1979 Fenwick ..... 5/66

4,188,540 2/1980 Reiniger ..... 269/323 X

*Primary Examiner*—Robert C. Watson

*Attorney, Agent, or Firm*—Marc D. Schechter

[57] ABSTRACT

A counterbalanced support, for example for supporting a patient or a radiation source in X-ray diagnosis or therapy, comprises a supporting frame movably mounted on a base by means of a parallelogram linkage. This linkage comprises two parallel rods which are pivotally connected to the supporting frame and the base. One of the rods has an arm formed thereon. A constant force is applied to the arm for counterbalancing the weight of the supporting frame and its load. This force is supplied by a pneumatic pulling device via apparatus which are freely movable with respect to the base, so that a substantially constant pulling force is exerted on the arm in a direction which extends at a fixed angle to the vertical.

6 Claims, 4 Drawing Figures

COUNTERBALANCED SUPPORT

BACKGROUND OF THE INVENTION

The invention relates to a support comprising a supporting frame which is movably connected to a base by means of a parallelogram linkage. The linkage comprises two parallel coupling rods each of which is pivotable, around first and second parallel axes, relative to the base and the supporting frame respectively. One coupling rod comprises an arm. A constant counterbalancing force acts at a point on the arm in a direction which, extends at a first fixed angle with respect to the vertical. The direction of the force is in a plane which is transverse to the pivotal axes of the coupling rods. The supplement of this first fixed angle is substantially equal to a second fixed angle; the second fixed angle is between a first line, which connects the point at which the force acts on the arm to the first pivotal axis of the coupling rod which is provided with the arm, and a second line, which interconnects the two pivotal axes of this coupling rod. The supplement of the first fixed angle is also substantially equal to a third angle, the third angle is formed by a third line, which interconnects the second pivotal axes of the two coupling, and a fourth line, which connects the second pivotal axis of the other coupling rod to the common center of gravity of the supporting frame and a load supported thereon. The ratio of the lengths of the first and the second lines is equal to the ratio of the lengths of the third and the fourth lines.

A support of this kind is very suitable for supporting medical equipment, for example, a radiation source or a patient chair, in X-ray diagnosis and radiation-therapy apparatus.

German Pat. No. 939,348 discloses a support of the above construction in which the counterbalancing force is supplied by a counterweight which is connected to the arm. At the point of application of the counterbalancing force on the arm, the direction of the force always coincides with the vertical, regardless of the position of the supporting frame relative to the base. This counterbalancing force compensates for the weight of the supporting frame, and a load positioned thereon to the same extent regardless of the position of the supporting frame. This is because at the point of its application on the arm, the weight exerts a force whose direction coincides, like the counterbalancing force, with the vertical, regardless of the position of the supporting frame relative to the base. The force is constant because a fixed relationship exists with the weight. Therefore, for adjustment of the supporting frame a constant force is required, thus enabling accurate adjustment by hand.

A drawback of this known support is that since, counterbalancing is effected by means of a counterweight, the support is comparatively heavy when used for supporting comparatively heavy loads. For example, if the support is used for supporting a patient bed having a weight of from 250 to 500 N on which a patient having a weight of 750 N is positioned, and if the supporting frame has a weight of from 250 to 500 N and the ratio of the counterweight to the weight is from 2 to 3, then a counterweight of from 3,000 to 4,000 N must be used. When the weight of the base (from 500 to 1,000 N) is added to these weights, a total weight of from 5,000 to 7,000 N is obtained for the assembly; such a weight is unacceptable in practice.

SUMMARY OF THE INVENTION

According to the invention there is provided a support comprising a supporting frame which is movably connected to a base by means of a parallelogram linkage. The linkage comprises two parallel coupling rods each of which is pivotable, around first and second parallel axes, relative to the base and the supporting frame respectively. One coupling rod comprises an arm. A constant counterbalancing force acts at a point on the arm in a direction which extends at a first fixed angle with respect to the vertical. The direction of the force is in a plane which is transverse to the pivotal axes of the coupling rods. The supplement of the first fixed angle is substantially equal to a second fixed angle; the second fixed angle is formed by a first line, which connects the point at which the force acts on the arm to the first pivotal axis of the coupling rod which is provided with the arm, and a second line, which interconnects the two pivotal axes of this coupling rod. The supplement of the first fixed angle is also substantially equal to a third angle; the third angle is formed by a third line, which interconnects the second pivotal axes of the two coupling rods, and a fourth line, which connects the second pivotal axis of the other coupling rod to the common center of gravity of the supporting frame and a load supported thereon. The ratio of the lengths of the first and the second lines is equal to the ratio of the lengths of the third and the fourth lines.

The counterbalancing force is supplied by a pneumatic pulling device which interconnects the arm, at the point at which the force is applied, and a carriage, which is displaceable in the base in a direction extensing transverse to the pivotal axes of the coupling rods. A substantially constant pulling force is exerted on the arm from the carriage in a direction which extends at a fixed angle with respect to the vertical.

Because the carriage is displaceable in the base, adjustment of the supporting frame with respect to the base will always result in the carriage being so positioned, with respect to the point of application of the pulling force on the arm, that at this point a counterbalancing device is applied by the pulling force in a direction which extends at a fixed angle with respect to the vertical. The counterbalancing force is constant and acts in a direction which extends at a fixed angle with respect to the vertical, regardless of the position of the supporting frame relative to the base. Because the weight of the supporting frame and a load supported thereon also produces a force of constant direction and magnitude at the point of application on the arm, regardless of the position of the supporting frame relative to the base, the weight is fully counterbalanced in all positions of the supporting frame. As a result accurate adjustment of the supporting frame by hand is possible. Because the counterbalancing force is supplied by a pneumatic pulling device, the construction of the support may be substantially lighter than that of the above known support. For the example described above, assuming a weight of from 250 to 500 N for a pneumatic pulling device, a saving in weight of approximately 50% is achieved.

Embodiments of the invention will be described in detail hereinafter, by way of example, with reference to the accompanying drawing.

DESCRIPTION OF THE PREFERRED EMBODIMENTS

Figure 1:
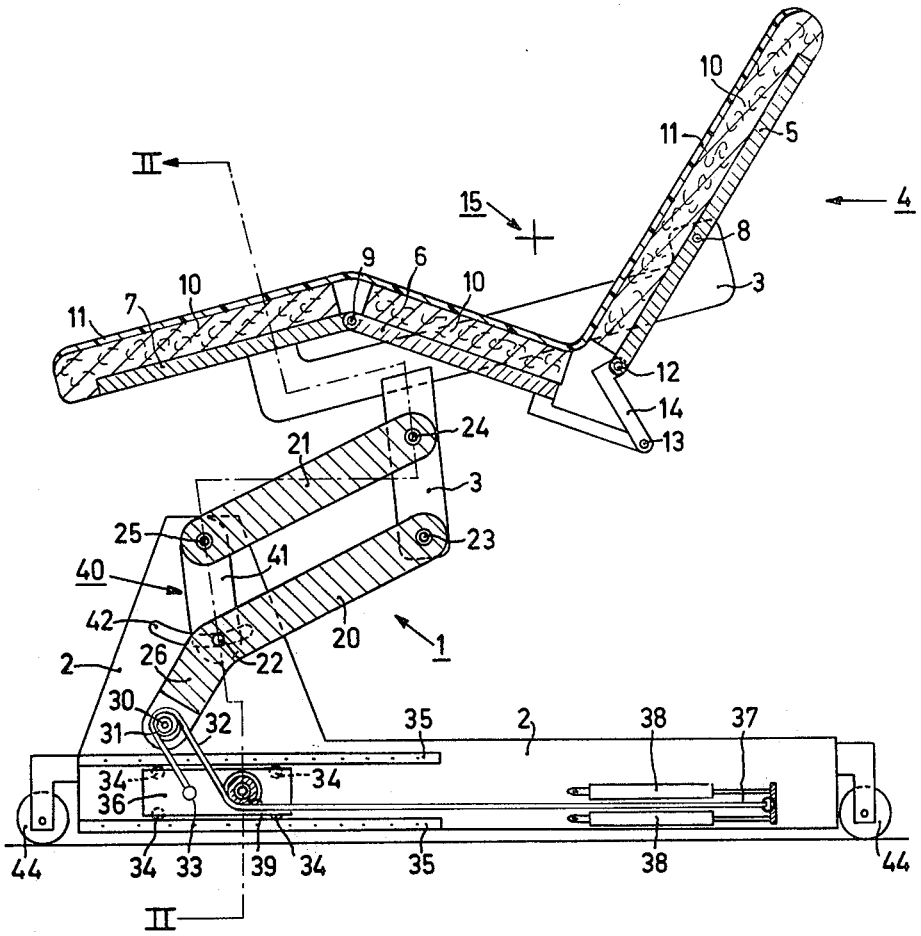
FIG. 1 is a sectional view of one embodiment of a support according to the invention.
Figure 2:
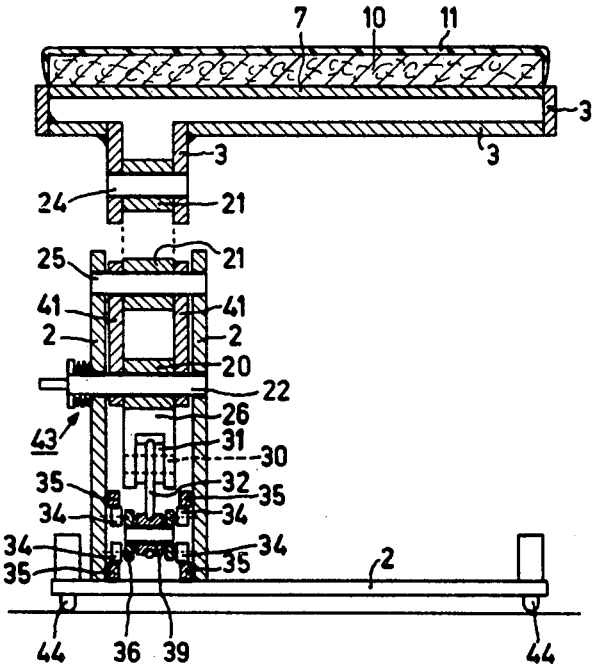
FIG. 2 is a cross-sectional view of the support shown in FIG. 1, taken along the line II—II.

The support shown in FIGS. 1 and 2 comprises a supporting frame 3 which is movably connected to a base 2 by means of a parallelogram linkage 1. The supporting frame 3 carries, for example, a patient support 4. Patient support 4 comprises a supporting member 5 for supporting the torso and head of the patient, a supporting member 6 for supporting the lower part of the body and the thighs of the patient, and a leg support 7. The supporting members 5 and 6 are pivotably supported by two parallel shafts 8 and 9 which are mounted on the supporting frame 3. For the patient's comfort a mattress 10 is provided on the supporting members 5 and 6, the mattress being covered by a cover 11 made of an elastic fabric. The supporting members 5 and 6 are coupled to one another at their adjacent ends by a single coupling rod 14 which is pivotably connected at its ends to the supporting members 5 and 6 by shafts 12 and 13. When the supporting member 5 is pivoted counterclockwise, as viewed in FIG. 1, the supporting member 6 is pivoted clockwise under the influence of the coupling rod 14; when the supporting member 5 is pivoted clockwise, the supporting member 6 is forced to pivot counterclockwise. As a result of this forced pivoting in opposite directions, the length of the supporting surface available for a patient, measured over the cover 11, is adapted to the changing length of the side of a supported patient which faces the patient support. As a result, during pivoting there will hardly be any relative movement between the patient and the support when the positions of the supporting members 5 and 6 are changed with respect to each other.

The shafts 8 and 9 are so arranged with respect to the supporting members 5 and 6 that the center of gravity of the combination formed by the supporting member 5 and the part of a patient supported thereby is situated to the right of the shaft 8 in the drawing. The center of gravity of the combination formed by the supporting member 6 and the part of a patient supported thereby is situated to the right of the shaft 9 in the drawing. Thus, when the supporting members 5 and 6 are pivoted with respect to each other, the torques required for the pivoting movement will at least partly counterbalance each other due to the coupling by the coupling rod 14. Moreover, the center of gravity of the patient support with the patient, diagrammatically denoted by the reference numeral 15, will not be substantially shifted.

The parallelogram linkage 1 comprises two coupling rods 20 and 21 which are pivotable at their ends around parallel shafts 22, 23, 24 and 25. Shafts 22 and 25 connect the rods 20 and 21 to the base 2 and shafts 23 and 24 connect the rods 20 and 21 to the supporting frame 3. By means of a pneumatic pulling device yet to be described, a pulling force is exerted on a shaft 30, connected to an arm 26 which is rigidly connected to the coupling rod 20, in order to counterbalance the weight of the supporting frame 3 and the load supported thereon. In this case, the patient load is patient support 4 with a patient (not shown).

Figure 3:
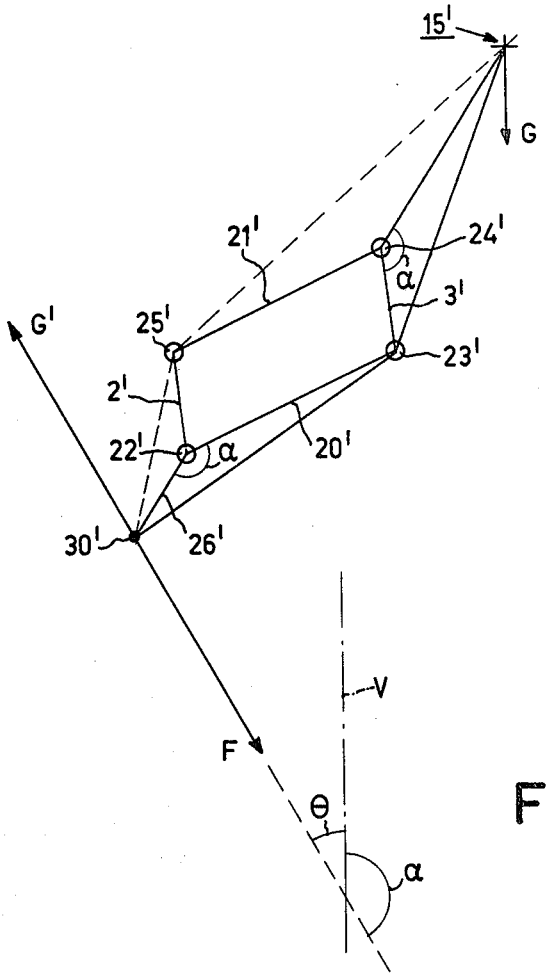
FIG. 3 is a diagrammatic representation of a number of parts of the support shown in FIGS. 1 and 2 which are important for a proper understanding of the operation of the support.

In order to explain this counterbalancing, reference is made to FIG. 3 which shows, in diagrammatic form, a number of parts of the support shown in FIGS. 1 and 2 which are of importance for a proper understanding of the operation of the support. The reference numerals in FIGS. 3 are the same as the reference numerals of corresponding parts in FIGS. 1 and 2, with the addition of a prime.

The pneumatic pulling device mentioned above exerts an at least substantially constant pulling force F on the arm 26' in a direction which extends at a fixed angle $\theta$ with respect to the vertical V. The supplement $\alpha$ of the angle $\theta$ is substantially equal to the fixed angle $\alpha$ which is formed by a first line which connects the point of application 30' of the force F on the arm 26' to the pivotal axis 22' of the coupling rod 20' and a second line which interconnects the two pivoted axes 22' and 23' of the coupling rod 20'. The supplement $\alpha$ of the fixed angle $\theta$ is also substantially equal to the angle $\alpha$ which is formed by a third line which interconnects the pivotal axes 23' and 24' of the coupling rods 20' and 21' respectively, and a fourth line which connects the pivotal axis 24' of the coupling rod 21' to the common center of gravity 15' of the supporting frame 3' and the load supported thereon, in this case the patient support 4 of FIGS. 1 and 2. The ratio of the lengths of the first line 30', 22' and the second line 22', 23' equals that of the lengths of the third line 23', 24' and the fourth line 24', 15'. This means that the triangle 30', 22', 23' and the triangle 23', 24', 15' are similar triangles and that the direction of the force G' applied at the point 30' by the weight G of the supporting frame 3' and the load supported thereon, also extends at the fixed angle $\theta$ with respect to the vertical. A fixed ratio exists between the magnitude of the force G' and the magnitude of the weight G. This ratio is equal to the product of the ratio of the lengths of the lines 22', 23' to 23', 24' and the ratio of the lengths of the lines 30', 22' to 23', 24'. As the angle $\alpha$ is fixed and invariable, because the arm 26' on which the pulling device acts is rigidly connected to the coupling rod 20', the weight G is substantially completely counterbalanced, regardless of the position of the supporting frame, by a force F which equals G'.

The pneumatic pulling device shown in FIGS. 1 and 2 comprises a flexible elongate pulling member 32, for example a chain or a cable, and two interconnected gas springs 38. Gas springs 38 exert a constant pulling force on the pulling member 32 and are fixedly arranged in the base. The pulling member 32 is guided around a first pulley 31 which is mounted on the shaft 30 on the arm 26. One end 37 of the member 32 is connected to the gas springs 38 and the other end 33 is connected to a carriage 36. The carriage 36 is movable, by means of wheels 34 on horizontal rails 35, in a direction extending transverse to the pivot shafts 22, 23, 24, and 25 of the coupling rods 20 and 21. The carriage 36 carries a second pulley 39 around which the pulling member 32 is guided between its end 37 and the pulley 31. Because the carriage 36 can move freely on the horizontal rails 35, it will automatically be positioned so that the pulling force (F in FIG. 3) exerted on the shaft 30 through the pulling member 32 always acts in a direction which extends at an angle $\theta$ of 30° with respect to the vertical, regardless of the position of the supporting frame 3 relative to the base 2. The angle $\alpha$ in FIG. 3 is consequently equal to 150°.

The supporting frame 3 with the patient support 4 mounted thereon can be tilted as an assembly around the shaft 25, because the pivot shaft 22 of the coupling rod 20 is carried by a cradle 40 which is pivotable around the shaft 25. Cradle 40 consists of two arms 41. The shaft 22 is guided in an arcuate slot 42 in the base 2 and can be locked by means of a clamping device 43. Because the angle formed by the arm 26 and the coupling rod 20 (the angle $\alpha$ in FIG. 3) does not change during this tilting motion around the shaft 25, the weight of the supporting frame with the load supported thereon is substantially completely counterbalanced during this tilting motion.

The parallelogram linkage 4 is preferably disposed at one side of the supporting frame 3 and the base 2 so that the space available for equipment is comparatively large. Base 2 is also provided with wheels 44.

Figure 4:
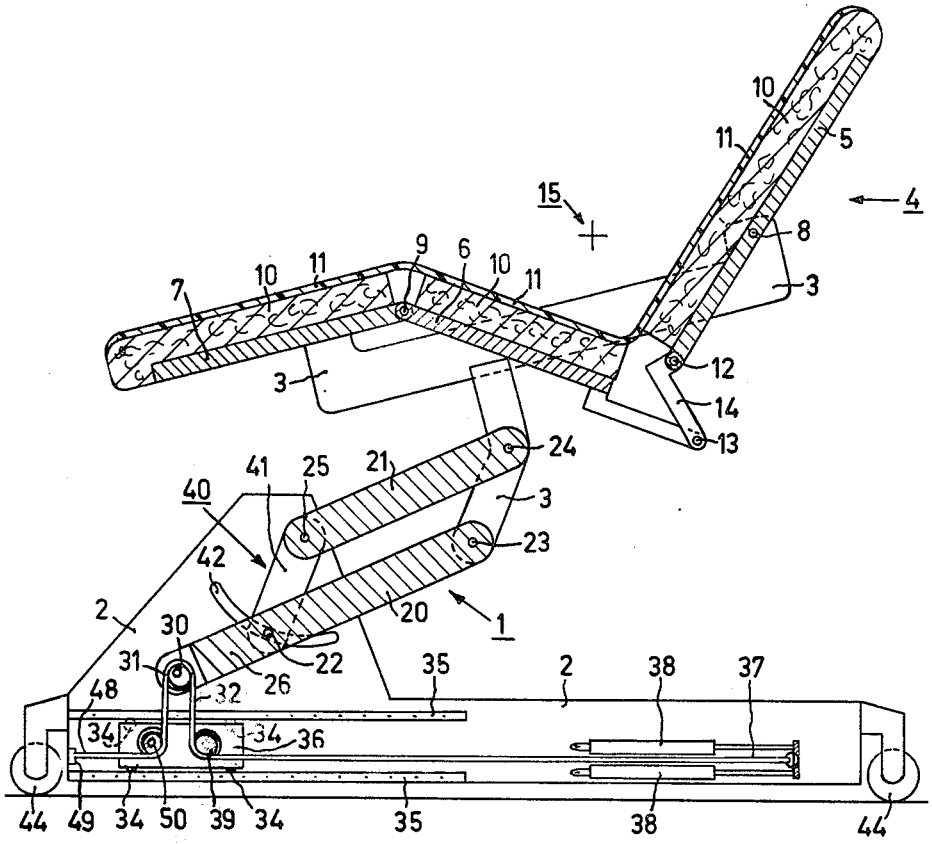
FIG. 4 is a sectional view of a further embodiment of a support according to the invention.

FIG. 4 is a sectional view of a further embodiment of a support according to the invention. In FIG. 4, corresponding parts are denoted by the same reference numerals as used in FIGS. 1 and 2. The pneumatic pulling device comprises a flexible elongate pulling member 32, for example, a chain or a cable, and two interconnected gas springs 38. Gas springs 38 exert a constant pulling force on the pulling member 32 and are fixedly arranged in the base. The pulling member 32 is guided around a first pulley 31 which is mounted on the shaft 30 on the arm 26. One end 37 of the member 32 is connected to the gas springs 38 while the its other end 48 is connected to a clamp 49 which is rigidly mounted on the base 2. Between its end 37 and the first pulley 31, the pulling member 32 is guided around a second pulley 39. Between its end 48 and the first pulley 31, member 32 is guided around a third pulley 50. The pulleys 39 and 50 are rotatably mounted on a carriage 36 which is movable, by means of wheels 34 on horizontal rails 35, on the base 2 in a direction extending transverse to the pivot shafts 22, 23, 24 and 25 of the coupling rods 20 and 21. Because the carriage 36 can move freely on the horizontal rails 35, it will automatically be positioned so that the pulling force (F in FIG. 3) exerted on the shaft 30 through the pulling member 32 always acts in a direction which extends at an angle $\theta$ of 0° with respect to the vertical, regardless of the position of the supporting frame 3 relative to the base 2. The angle $\alpha$ in this embodiment is consequently equal to 180°. In other words, the pulling force on the shaft 30 acts along the vertical and the arm 26 forms a colinear extension of the coupling rod 20.

What is claimed is:

1. An adjustable support comprising:

a base;

a parallelogram linkage;

a supporting frame, movably connected to the base by means of the parallelogram linkage; and means for applying a constant counterbalancing force at a point on the arm, said force being directed transverse to each of the pivotal axes of the coupling rods and in a direction which is at a first fixed angle with respect to the vertical;

wherein the parallelogram linkage comprises:

(i) a first coupling rod, pivotable relative to the base around a first axis and pivotable relative to the supporting frame around a second axis, said first coupling rod having an arm; and (ii) a second coupling rod, pivotable relative to the base around a third axis and pivotable relative to the supporting frame around a fourth axis, said second coupling rod being parallel to the first coupling rod;

(iii) said first, second, third, and fourth axes being parallel to each other;

wherein the supplement of the first fixed angle is substantially equal to a second fixed angle between a first line, which connects the point at which the force acts on the arm to the first axis, and a second line, which connects the first and second axes;

wherein the supplement of the first fixed angle is also substantially equal to a third angle between a third line, which connects the second and fourth axes, and a fourth line, which connects the fourth axis to a common center of gravity of the supporting frame and a load support thereon; and wherein the ratio of the length of the first line to the length of the second line is equal to the ratio of the length of the third line to the length of the fourth line;

characterized in that;

the means for applying the counterbalancing force comprise:

a pneumatic pulling device; and a carriage, displaceable on the base in a direction transverse to the pivotal axes of the coupling rods;

said pulling device interconnecting the carriage and the arm at the point of application of the counterbalancing force on the arm.

2. An adjustable support as claimed in claim 1, characterized in that:

a first pulley is mounted on the arm at the point of application of the counerbalancing force;

a second pulley is mounted on the carriage, the carriage being displaceable horizontally on the base;

the second fixed angle is equal to 150°; and the pneumatic pulling device comprises a gas spring, arranged on the base, and a flexible elongate pulling member having two ends, the pulling member being connected at one end to the gas spring and at the other end to the carriage, said member extending from the carriage around the first pulley then around the second pulley to the gas spring.

3. An adjustable support as claimed in 1, characterized in that:

a first pulley is mounted on the arm at the point of application of the counterbalancing force;

second and third pulleys are mounted on the carriage, the carriage being displaceable horizontally on the base;

the second fixed angle is equal to 180°; and the pneumatic pulling device comprises a gas spring, arranged on the base, and a flexible elongate pulling member having two ends, the pulling member being connected at one end to the gas spring and at the other end to the base, said member extending from the base around the second pulley to and around the first pulley and then around the third pulley to the gas spring.

4. An adjustable support as claimed in claim 1, 2, or 3, characterized in that the support further comprises:

a cradle pivotable relative to the base around the third axis; and a shaft, supported by the cradle, which pivotably supports the first coupling rod at the first axis.

5. An adjustable support as claimed in claim 4, characterized in that the supporting frame comprises a patient support comprising:

two supporting members, each having a first end and a second end, each supporting member being pivotably mounted at its first end to the supporting frame; and a coupling rod having two ends, each end pivotably connected to one of the second ends of the supporting members.

6. An adjustable support comprising:

a base;

a parallelogram linkage;

a supporting frame movably connected to the base by means of the parallelogram linkage; and means for applying a substantially constant counterbalancing force at a point on the arm, said force being directed transverse to each of the pivotal axes of the coupling rods;

wherein the parallelogram linkage comprises:

(i) a first coupling rod, pivotable relative to the base around a first axis and pivotable relative to the supporting frame around a second axis, said first coupling rod having an arm; and (ii) a second coupling rod, pivotable relative to the base around a third axis and pivotable relative to the supporting frame around a fourth axis, said second coupling rod being parallel to the first coupling rod;

(iii) said first, second, third, and fourth axes being parallel to each other;

characterized in that:

the means for applying the counterbalancing force comprise:

means for applying a substantially constant force;

a carriage, displaceable on the base in a direction transverse to the pivotal axes of the coupling rods;

said means for applying a substantially constant force interconnecting the carriage and the arm at the point of application of the counterbalancing force on the arm.

* * * * *